United States Patent [19]

Paulus et al.

[11] 4,395,022

[45] Jul. 26, 1983

[54] METHOD OF AND APPARATUS FOR CONTROLLED COOLING OF METALLURGICAL PRODUCTS

[75] Inventors: Philippe A. Paulus; Marios Economopoulos, both of Liege, Belgium

[73] Assignee: Centre de Recherches Metallurgiques-Centum voor Research in de Metallurgie, Brussels, Belgium

[21] Appl. No.: 874,629

[22] Filed: Feb. 2, 1978

[30] Foreign Application Priority Data

| | | | |
|---|---|---|---|
| Feb. 8, 1977 | [BE] | Belgium | 851213 |
| Apr. 29, 1977 | [BE] | Belgium | 854158 |
| May 10, 1977 | [BE] | Belgium | 854478 |

[51] Int. Cl.[3] ..... C21D 9/56

[52] U.S. Cl. ..... 266/106; 140/2; 266/112; 266/131

[58] Field of Search ..... 72/201; 140/2; 266/106, 266/112, 113, 131, 129, 133

[56] References Cited

U.S. PATENT DOCUMENTS

| | | | |
|---|---|---|---|
| 3,340,109 | 9/1967 | Keough | 266/131 X |
| 3,704,874 | 12/1972 | Van den Bulcke | 266/106 X |
| 3,788,618 | 1/1974 | Van den Bulcke | 266/106 X |
| 3,854,707 | 12/1974 | Armstrong et al. | 266/129 X |
| 4,054,276 | 10/1977 | Wilson | 266/106 |

*Primary Examiner*—Paul A. Bell

*Attorney, Agent, or Firm*—Holman & Stern

[57] ABSTRACT

A metallurgical product, e.g. wire rod emerging from a hot rolling mill, is subjected to controlled cooling by immersing it in a bath, e.g. an aqueous bath, kept at a given temperature. During immersion, the bath is stirred, e.g. mechanically or by means of a fluid. In a controlled cooling installation a cover arranged above the bath has a condenser for recovering vapor from the bath.

4 Claims, 3 Drawing Figures

METHOD OF AND APPARATUS FOR CONTROLLED COOLING OF METALLURGICAL PRODUCTS

The present invention relates to a method of and an apparatus for controlled cooling of metallurgical products, in particular wire, rod and flat products such as sheets, e.g. steel sheets.

Numerous methods of effecting controlled cooling have already been suggested which aim at giving the metallurgical products a microstructure and mechanical properties comparable with those obtainable for example by well-known lead patenting. These cooling methods are generally effected at the outlet of the last stand of a rolling mill and comprise placing the products which are at a high temperature in contact with a fluid or medium those heat transfer coefficient is very large. We have already suggested using a cooling fluid comprising an aqueous solution, in particular a hot-water bath kept at its boiling temperature. Other media are known, such as a mist (either salty or not) and a fluidized bed, etc.

The value of the heat transfer coefficient of the cooling medium is very important in methods of this kind to attain the desired result. Extensive reasearch is still being made world-wide with a view to improving heat exchange between the various fluids used, since complex phenomena are involved in which a large number of factors play a part. Some solutions have been found which still have a number of drawbacks such as that of being expensive or of unduly complicating the operation.

The present invention provides a method in which metallurgical products such as wires, rods, or sheets are controllably cooled by being immersed in a bath kept at a suitable temperature, e.g. a hot water bath kept at its boiling temperature, substantially characterized in that the said bath is stirred during operation.

This way of proceeding improves the heat transfer coefficient of the bath, which makes it possible to better control the cooling in certain applications.

Advantageously the method is applied to metallurgical products at the outlet of the last stand of a rolling mill.

Preferably, the bath to which the stirring is applied is a boiling water bath. The bath can be stirred by mechanical means. Alternatively (or additionally), the bath can be stirred by means of a fluid injected into the bath, for example by means of sprayers immersed in the bath.

It is within the scope of the present invention to apply the above described method to strip which does not emerge from a rolling mill but has been cold rolled and should have good ductility, drawing, and elongation properties. As is known, when these properties are desired, metal products are usually subjected to recrystallization annealing in a wound or coiled condition in a bell furnace. However, this treatment is costly because it is long and of poor productivity; moreover, the results thus obtained are far from uniform. To remedy these drawbacks, it has already been suggested to substitute a continuous heat treatment for this annealing treatment. Despite numerous proposed variants, it is still impossible to surely obtain satisfactory homogeneity in the properties of the sheets throughout its width, and good ductility, while retaining an acceptable duration of the treatment. Thus, with a view to remedying these drawbacks, a continuous heat treatment process has already been suggested comprising heating to a temperature higher than the recrystallization temperature, and rapid cooling by immersing the sheet thus heated in an aqueous bath kept substantially at its boiling temperature.

Starting from these considerations, it has been found advantageous to subject the sheets to the above described process after the sheets have been heated to a temperature higher than its recrystallization temperature, the bath in which the sheets are subsequently quenched being at a temperature higher than 75° C.

According to an advantageous variant of this modification, the sprayers are arranged so that continuous circulation is obtained in the bath from the periphery towards the centre or vice versa, the circulation occurring along a closed circuit.

According to another advantageous modification of this method, steam produced when the sheet enters the bath is recycled in a contact condenser whose heat absorption capacity is such that all the condensed water returns to the bath at the highest possible temperature, preferably higher than 90° C.

Moreover, the side walls of the vessel containing the bath are preferably heated.

The present invention also relates to an apparatus for carrying out the above described methods. The following description of this apparatus is made with reference to its application to wire rod but this is done only by way of example.

As is known, most of the characteristics of the wire rod, e.g. its mechanical properties, its microstructure, the homogeneity of its microstructure, and the nature and thickness of the scale, depend almost exclusively not only on the treatment to which the wire rod has been subjected in the last stands of the rolling mill, but also on all the treatments, e.g. controlled cooling, to which it has been subjected after emergence from the rolling mill.

To obtain good quality wire rod, especially wire rod designed to be wire drawn, the product is usually subjected to prepatenting and patenting by molten lead. Since these operations are particularly costly, the producers are trying to discover methods which make it possible, by means of less costly operations, to give the wire properties substantially identical to those obtainable by patenting operations. To this end, to save the cost of a prepatenting operation, installations have already been suggested for controllably cooling coiled wire rod arranged with its turns, not in contact with one another, either spread on a conveyor belt or wound about the same axis.

The present invention relates to improvements in an apparatus of this kind, which makes it possible to obtain in more economical conditions wire having more homogeneous properties while eliminating both the prepatenting and the patenting operation.

The installation according to the present invention comprises a device for accommodating wire rod emerging from the last stand of a rolling mill, a device for coiling the wire rod, and a device for spreading the wire rod in spaced turns on a conveyor, the said conveyor being arranged inclined in a vessel containing an aqueous fluid, the said vessel being covered by a hood which prevents excessive cooling of the bath, which is usually at its boiling temperature. In most cases, a condenser is provided in the hood to recover evaporation products. Finally, the inclination of the conveyor and the direction along which the wire turns are displaced are such that the wire turns, after having been placed at the lower point of the conveyor, are progressively raised towards the upper surface of the bath and leave the bath at a predetermined distance from the outlet end of the vessel.

To obtain rod particularly suitable for wire drawing, its mechanical characteristics must be as homogeneous as possible around values considered to be optimum, and its structure must be as uniform as possible. All these conditions must be met both in each single turn and throughout the length of the coil. The outlet temperature of the rod, however, must be adjustable within a predetermined range.

As already mentioned above, the present invention relates to an improved installation by means of which it is possible to obtain rod meeting the above described conditions, this being true both for hard-steel and mild-steel rod.

The invention will be described further, by way of example only, with reference to the accompanying drawings, not to scale, in which:

FIG. 1 shows in a very simplified way a kind of installation in which improvements according to the present invention are applied. In FIG. 1:

Figure 1:
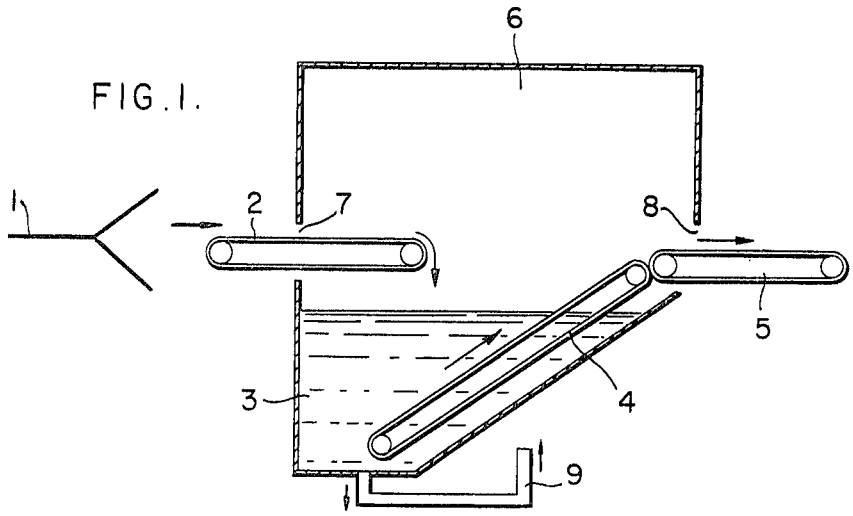
FIG. 1 is a diagrammatic view of an installation for cooling wire rod.

1—indicates a coil-forming device;

2—indicates an additional conveyor, e.g., a roller conveyor, which receives turns of wire rod from the device 1 and conveys them to a point above the bath, thereby preventing the coiling device 1 from coming into contact with steam;

3—indicates a hot-water treatment (i.e. controlled cooling) vessel for the wire rod, the water in the vessel being near to its boiling temperature, the side walls of this vessel preferably being heat insulated to obtain uniform temperature throughout the bath;

4—indicates an inclined and partially immersed conveyor having a horizontal extension 5 to convey the spaced turns of rod out of the vessel 3,

6—indicates a cover formed with only two openings, which are as narrow as possible, one opening 7 being an inlet for the turns of rod and the other opening 8 being an outlet for them;

9—indicates a device for circulating, filtrating, homogenizing, and maintaining the level of the water bath contained in the vessel 3, this device causing stirring of the bath.

The installation diagrammatically illustrated in FIG. 1, in accordance with the invention, is designed to ensure a uniform temperature practically throughout the entire volume of the aqueous bath, this temperature being as high as possible, i.e. higher than 90° C., preferably 95° C.

The possibility of providing operating conditions which make it possible to treat in the same installation both hard steel and mild steel rods, practically without wasting time in modifying the installation, has led us to provide our installation with a device for adjusting within a wide range the level of the liquid bath in the treatment vessel, and for providing permanent forced circulation of the bath, so as to ensure excellent homogenization of the bath temperature and to allow filtration of the bath liquid, for example.

As already mentioned above, a cover is arranged above the vessel and serves to condense escaping vapours and to reduce heat losses from the bath. Preferably, the lid has one portion designed to condense vapours and another portion designed to prevent heat losses, the respective exposed areas of these two portions being adjustable at will in accordance with the level of the bath in the treatment vessel. Such adjustment may be effected by means of a mobile refractory vault (constituting the portion designed to prevent heat loss) arranged underneath the condensing portion of the cover and horizontally displaceable beneath it so as to cover only the part of the condensing portion directly above the non-immersed part of the inclined conveyor. (Such displacement is effected for example similarly to a drawer.)

Figure 2:
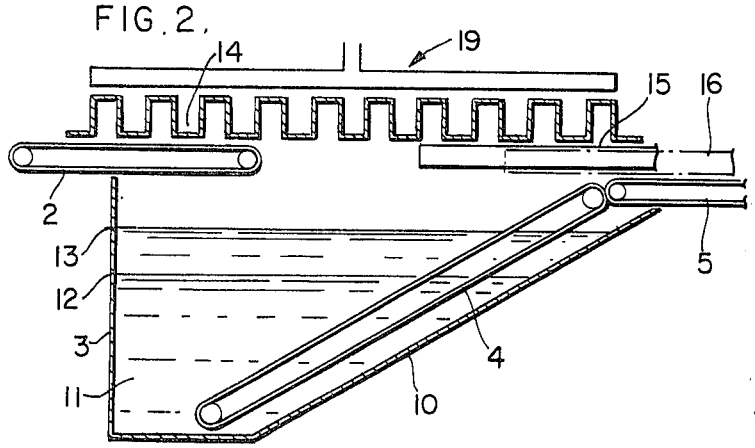
FIG. 2 is a diagrammatic view of another installation for cooling wire rod.
Figure 3:
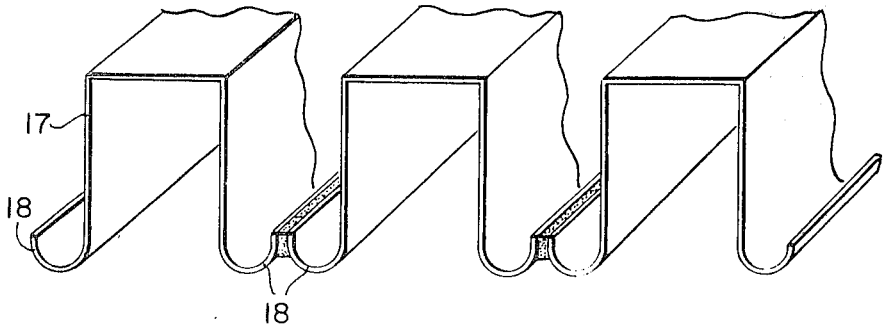
FIG. 3 is a fragmentary perspective view of a cover of the installation shown in FIG. 2.

An embodiment of such an installation according to the invention is illustrated in FIGS. 2 and 3.

FIG. 2 shows an inlet conveyor 2 which supplies turns of wire rod to the vessel 3 the bottom 10 of which follows the inclination of the conveyor 4. The vessel 3 is filled with an aqueous liquid 11 whose surface level can vary according to requirements. The level 12 corresponds to a bath for treating a mild-steel rod, while a higher level 13 corresponds to a bath for treating hard-steel rod.

A cover arranged above the vessel 3 comprises a corrugated member 14 extending over the entire vessel and a highly insulating slide or drawer 15 which is arranged underneath the member 14 at the outlet of the vessel and which is capable of horizontally sliding along a longitudinal or transverse axis of the vessel so as to occupy the most suitable position. In the drawing, the position of the slide indicated by the broken line 16 corresponds to the level 12 and that indicated by the solid line 15 corresponds to the level 13. In these two positions, the refractory slide makes it possible to reduce as much as possible the cooling speed of the wire (e.g. so that in this zone a mild steel rod emerging from the bath is kept at a temperature of 625° to 400° C.). The refractory slide, which can also extend above the additional conveyor, covers only the non-immersed part of the conveyor 4, the remaining part of the conveyor and thus of the bath being directly covered by the corrugated member 14. This member is advantageously formed by a series of caissons 17 which are cooled at their upper surface by air or water from fluid supply means 19 and are laterally provided with drain channels 18 for recovering the cooling fluid (see FIG. 3). The caissons 17 are sealingly secured to one another in a manner known per se. Preferably, a sufficient number of caissons are provided to cover the entire treatment vessel, but it is still within the scope of the invention to cover only a portion of the vessel, e.g. the immersed portion of the inclined conveyor, the remaining part being then covered by the refractory slide, which has then to be as close as possible to the non-immersed part of the said conveyor to reduce the cooling rate of the rod emerging from the bath.

Since the installation must be adapted to treat both hard-steel rod and mild-steel rod, it is important to maintain the bath temperature at a level higher than 90° C., preferably higher than 95° C., to avoid any risk of quenching the hard steel. By taking into account the volume of the liquid contained in the vessel, it is easily possible to calculate the minimum value below which the condensed water temperature cannot decrease, and to adapt accordingly the cooling effect due to the condenser, in such a way that the condensed water does not cause a temperature decrease of the bath below the desired value. In practice, the condenser is designed in such a way as to ensure total condensation of the vapors and to obtain a condensate whose temperature is as high as possible, e.g. higher than 60° C. and preferably higher than 80° C.

Having in mind the above described installation according to the invention, it is now easier to understand its essential characteristics.

The installation in accordance with the present invention which is designed to give rolled products mechanical characteristics and a given structure, is substantially characterized in that it comprises, possibly at the outlet of the last stand of a rolling mill, a continuous-operation device conveying the rolled product to a vessel containing a bath at a suitable temperature, a hood arranged above the vessel and provided with a condenser for recovering vapours, means for continuously raising the rolled product out of the vessel, and means for keeping the bath at a substantially homogeneous temperature.

The bath in the vessel is in general an aqueous bath and has a temperature close to its boiling point.

In the case in which the rolled product is wire rod emerging from the rolling mill, the installation according to the invention has, at the outlet of the last stand of the rolling mill a device for coiling the rod into turns, a device for arranging the turns spaced from one another on a conveyor arranged in the vessel, the said conveyor having its input below the surface of the bath and its output above the surface of the bath.

Figure 4:
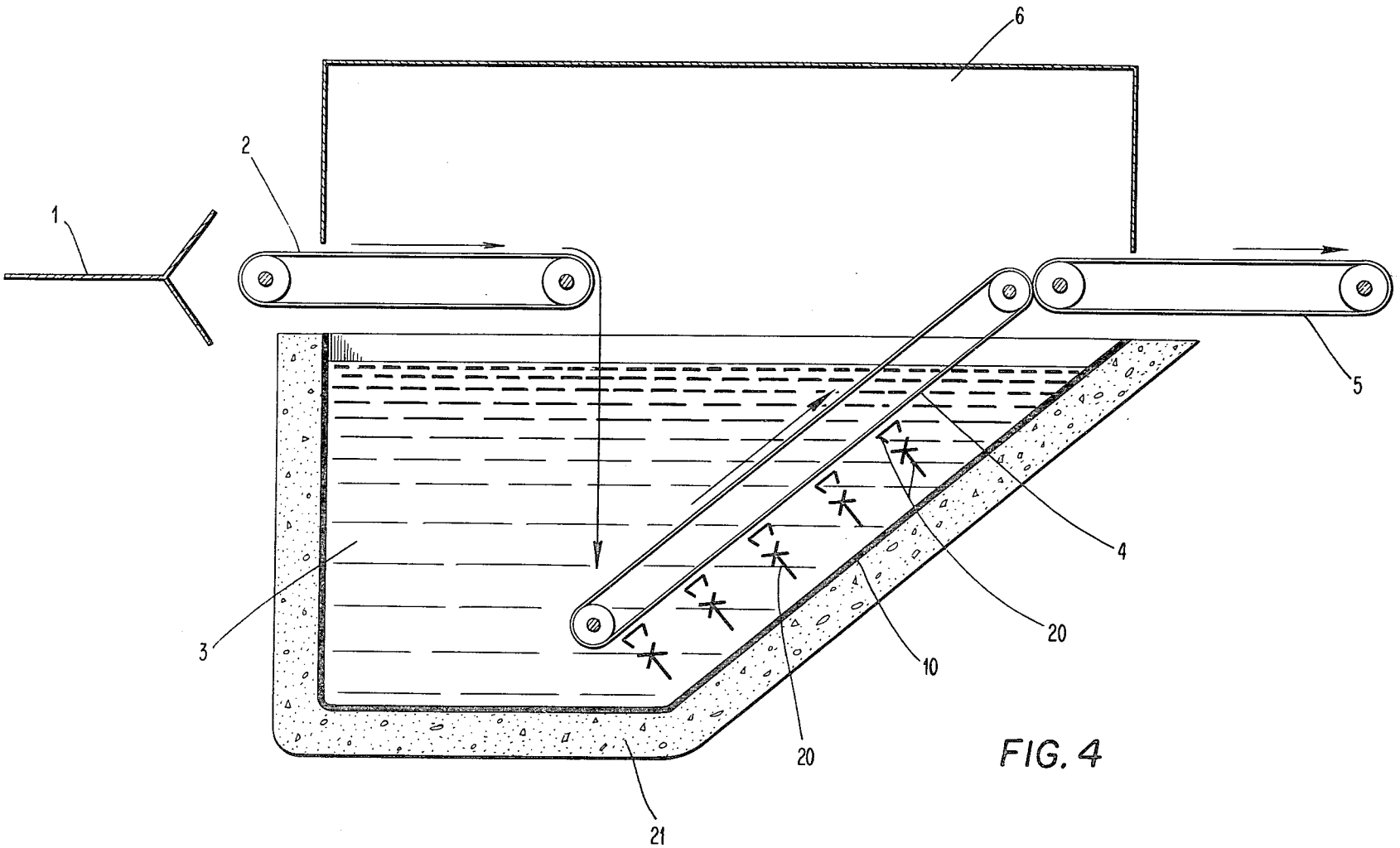
FIG. 4 is a diagrammatic view of a further installation for cooling wire rod.

According to an embodiment of the invention, as shown in FIG. 4 the means used for keeping the bath at a substantially homogeneous temperature are formed by sprayers 20 arranged inside the vessel to effect fluid circulation. The sprayers may be supplied at rates varying from one sprayer to another, in order to ensure complete allotropic transformation of any parts of the rod turns.

The treatment vessel also has heat insulated side walls 21.

According to a third embodiment of the invention, the treatment vessel is completely covered by a cover comprising two distinct parts, i.e.:

a first part formed by a staggered or corrugated condenser of the contact type arranged above the vessel and extending from its inlet side to at least a point where the conveyor emerges from the bath, a second portion which is a heat-insulating portion and which extends from the said point to the outlet of the vessel and possibly up to a point above a terminal conveyor arranged immediately after the conveyor in the vessel and designed to assure continuity in the conveyance of the rod turns outside the bath and the vessel.

Advantageously, the said cover may comprise a condenser extending over the entire vessel, and a heat-insulating member which may be arranged and displaced under the condenser, depending on the level of the bath in the vessel, so as to cover only the non-immersed part of the conveyor. Advantageously, the two parts of the lid, i.e. the condenser and the heat-insulating member, are each formed by similar elements the number of which is adapted to the respective parts to be covered in the vessel.

The contact condenser device as described above is preferably provided on its cooling side with a cooling fluid supply whose specific capacity is such that the water condensed is at a temperature higher than 60° C., preferably 80° C., when it falls back to the bath.

The staggered device described above in connection with the present invention is given by way of example only to explain the operation of the mechanism. Any devices clearly performing the same function must be considered as falling within the scope of the invention.

We claim:

1. An installation for controlled cooling of a metallurgical product, comprising, a vessel for holding a liquid bath, a device for continuously transferring the product to said vessel, a cover arranged above the vessel, said cover being provided with a condenser for recovering vapour from the bath, means for continuously raising the product from the vessel, and means for keeping a substantially homogeneous temperature throughout the bath, in which the cover of the vessel comprises:

(a) a first portion formed by a corrugated condenser of the contact type, arranged above the vessel and extending from its inlet side to at least a point where the conveyor or the product emerges from the path; and (b) a second portion which is of a heat-insulating nature and extends from the said point at least to the outlet of the vessel.

2. An installation as claimed in claim 1, in which the condenser extends over the entire vessel, and the heat-insulating portion is displaceable underneath the condenser.

3. An installation as claimed in claim 1, in which the said portions of the cover are each formed by a plurality of similar members.

4. An installation as claimed in claim 1, in which the bath is an aqueous bath and in which the contact-condenser is provided on its cooling side with a cooling-fluid supply means whose specific capacity is such that the condensate is at a temperature higher than 60° C. when it falls back into the bath.

* * * * *